US006045592A

United States Patent [19]

Paquin

[11] Patent Number: 6,045,592

[45] Date of Patent: Apr. 4, 2000

[54] METHOD AND KIT FOR DYEING SHAPED NYLON PLASTICS

[75] Inventor: Leanne Paquin, 3761 Manteo Cir., Orlando, Fla. 32837

[73] Assignee: Leanne Paquin, Orlando, Fla.

[21] Appl. No.: 09/149,695

[22] Filed: Sep. 8, 1998

[51] Int. Cl.[7] ..... D06P 3/24

[52] U.S. Cl. ..... 8/516; 8/DIG. 21; 434/84

[58] Field of Search ..... 8/506, 516, 924, 8/DIG. 21; 434/84; 206/1.8, 1.9

[56] References Cited

U.S. PATENT DOCUMENTS

| | | | |
|---|---|---|---|
| 2,212,772 | 8/1940 | Graves | 8/DIG. 21 |
| 2,354,744 | 8/1944 | Dreyfus | 8/DIG. 21 |
| 2,558,992 | 7/1951 | Stott | 8/516 |
| 3,003,989 | 10/1961 | Ehrhardt et al. | 8/516 |
| 3,197,270 | 7/1965 | Roth | 8/DIG. 21 |
| 3,677,689 | 7/1972 | Senago | 8/516 |
| 4,047,889 | 9/1977 | Hermes | 8/506 |
| 4,309,177 | 1/1982 | Kane et al. | 8/516 |
| 4,585,018 | 4/1986 | O'Connor | 132/120 |
| 4,609,375 | 9/1986 | Wilson et al. | 8/516 |
| 4,661,117 | 4/1987 | Wilson et al. | 8/516 |
| 4,802,255 | 2/1989 | Breuer et al. | 8/516 |
| 5,076,808 | 12/1991 | Hahn et al. | 8/516 |
| 5,154,193 | 10/1992 | Busch et al. | 132/110 |

*Primary Examiner*—Caroline D. Liott
*Attorney, Agent, or Firm*—Hayes, Soloway, Hennessey, Grossman & Hage, P.C.

[57] ABSTRACT

A process and novelty kit for permanently affixing a decorative color or color pattern to an aliphatic nylon plastic material, wherein the nylon is selectively preconditioned to maximize dye transfer and uptake, thereby providing a permanently decorated keepsake, such as, e.g., a decorated Easter egg. The process preferably includes selected molding and cooling conditions for the nylon, as well as preferably conditioning the nylon in heated aqueous media prior to the step of color decoration. Optionally, the dye itself can be pre-heated, and the dye can be applied to the nylon, while the nylon and dye are in contact with one another and are heated in a microwave or standard convection type oven. Alternatively, the nylon and dye can be left in contact with one another overnight, to produce the desired decorative color or color pattern on the nylon plastic material.

66 Claims, No Drawings

METHOD AND KIT FOR DYEING SHAPED NYLON PLASTICS

FIELD OF THE INVENTION

The present invention relates to a process and apparatus/kit for dyeing plastic material wherein the plastic so decorated provides a permanent keepsake novelty item. More specifically, the present invention relates to a child friendly method for dyeing nylon plastic materials in the shape of an egg or other type of ornamental figure, wherein the nylon is selectively pre-conditioned to provide enhanced uptake of color dye, thereby providing enduring decoration for years of future enjoyment.

BACKGROUND OF THE INVENTION

U.S. Pat. No. 5,565,229, and references cited therein, provides an excellent overview and background for the present invention. As described therein, coloring eggs has been an Eastern custom among many religious and national groups. In the United States, the art of decorating Easter eggs is a well-known annual activity which is employed by many people. Tie-dyeing, which is often used for color decoration, is a coloring process which can impart an intricate, aesthetic design to a given article. The publication "Taking a Dip-Tie Dyed Easter Egg Design Embellish Run-of-the-Mill Shell, The Arizona Republic, Apr. 5, 1997, by Susan Doerflet, specifically describes a method of tie-dyeing eggs by inserting the egg into a nylon stocking and immersing the egg/stocking in a bowl of die.

U.S. Pat. No. 5,565,229 goes on to disclose that while tie-dyeing of an egg was therefore known, such techniques did not allow for preparation of a detailed colored pattern to selected locations on the egg's surface. That being the case, U.S. Pat. No. 5,565,229 discloses a press and method for using the press to tie-dye eggs which press is said to comprise a planar material having a surface; a center fold line essentially dividing said planar material into two parts, each part having in the surface said planar material a depression such that when the planar material is folded along said centerfold line, the two depressions align to define a closed mold that is substantially egg-shaped, each depression having at least one predetermined locus for puncturing.

However, while methods and techniques such as those disclosed in U.S. Pat. No. 5,565,229 and the references cited therein are widely known for dyeing of eggs, one long-standing problem remains which is the fact that the eggs themselves, as a perishable commodity, ultimately fail to provide one with a permanently decorated keepsake. That being the case, on Easter, e.g., when a young child colors and decorates a perishable egg, the design placed thereon will ultimately be lost forever. Accordingly, it remains a significant problem in the art to the extent that memorabilia of one's childhood decorating activity has remained in long-stand need of a technique or process to forever preserve such precious memories.

In the field of plastic materials, it is known that plastic themselves can be pigmented through-out prior to molding into a final shape, and such pigments, done at the molding step, certainly provides a permanent effect therein. However, plastic materials, in view of their relatively smooth surfaces, often times resist surface treatment with dyes and/or paints, which has therefore restricted their use as a substrate for consumer applied decoration.

Nevertheless, plastic surfaces which otherwise resist decoration provide their own unique advantages, such as offering surfaces with reduced frictional characteristics, and surfaces which avoid sticking to cooked foods. In the latter case, poly(tetrafluroethylene) is an excellent example of a plastic polymeric material that is uniquely suited for application as a non-stick surface as applied to the manufacture of consumer cookware. In connection with an example of a plastic material with reduced frictional characteristics, it has been well-known, e.g., to employ a smoothed polyethylene based plastic surface for linings of truck beds and the like.

One form of plastic materials, known as the nylon resins, stands as reference to that family of polymers known generally as polyamides. Aliphatic polyamides, such as nylon-6,6 were largely developed by the pioneering work of Wallace H. Carothers at the DuPont Co., were promptly recognized as a synthetic fiber-forming material, as well as a plastic material with improved mechanical strength and/or heat resistance, suitable for molding of high-performance consumer products. In addition, while such applications certainly make use of nylon's beneficial properties, over the years, it has become known that nylons or polyamides have a unique characteristic of being "hydrophilic", which is reference to the fact that the polyamide chain itself can and will absorb water. Absorption of water, can, and will have certain negative effects in certain given applications. For example, water will tend to soften a nylon material, and render a drop in mechanical strength.

However, not surprisingly there have been numerous reports in the art dealing with control of water uptake, ranging from modification of the nylon structure itself blending, and/or the use of selected additives. Each of these solutions, so to speak, is accompanied with its own unique problems. For example, modifying the structure to reduce moisture absorption may also lead to changes in mechanical performance.

That being the case, it is a primary object of this invention to develop a process and apparatus/kit that would provide consumers the opportunity to color a plastic material, such as an egg shaped molded plastic form, such that the decoration thereon is preserved. More specifically, it is an object of this invention to select and condition the plastic material so that its ability to absorb colors is fully enhanced and one can obtain a preserved and intensely colored keepsake of one's decorating activity. In that regard, it is a more specific objective of the present invention to selectively condition a nylon, with consideration of its unique hydrophilic properties as noted above, such that the nylon/polyamide is made to more efficiently absorb a child friendly aqueous based dye, along with the development of an efficient technique for more vivid decorative color and patterns of colors than previously reported in the literature.

SUMMARY OF THE INVENTION

A process for permanently affixing a decorative color or color pattern to a nylon plastic material comprising supplying a molded nylon material, wherein the nylon material has been molded at a temperature range of between 420–540° F., and cooled to a temperature between 70–200° F. and contacting the said molded nylon material with an aqueous based dye.

In apparatus form, the present invention comprises a kit for permanently affixing a decorative color or pattern of colors to a nylon plastic material comprising the following components: a molded nylon material, wherein the nylon material has been molded at a temperature range of between 420–540° F., and cooled to a temperature between 70–200 F., including an aqueous dye.

DETAILED DESCRIPTION OF THE PREFERRED EMBODIMENTS

In accordance with the present invention, a product line of child created memorabilia (art pieces) is disclosed, including the methodology to quickly and easily decorate the memorabilia with the absorption of colors, and patterns of colors, into the surface of a plastic material, preferably an aliphatic nylon type plastic, such as nylon-6,6 or nylon-6.

The method of decoration is preferably accomplished by submersion of the selected and optionally conditioned plastic into a child-friendly aqueous dye or the application of the dye to the plastic via the use of felt or other absorbent cloth transfer media, such as sponge material or even paper. Preferably, the plastic is molded under those conditions that provoke the maximum absorption of dye.

In that regard, it has been found that in the case of the preferred nylon substrate, when such is molded into for example, an egg-shaped product, for decoration as herein described, it is preferred to mold such material at a temperature of 520° F. (barrel temperature), followed by injecting into the mold which was set at a temperature of about 180° F. That is, under these molding conditions, the most intense coloration is observed when treated with the aqueous based dyes.

However, in the broad context of the present invention, other temperature profiles have been found suitable. For example, the following molding temperature/cooling profiles also lead to well-decorated colored products in accordance with the invention herein: 420/130, 480/120, 500/130, 500/70 and 460/110, wherein the former temperature represents barrel temperature, and the latter temperature represents the mold temperature for cooling.

In a most preferred embodiment, it has been discovered herein that it is best to first heat the preferred nylon material in an aqueous medium of water or vinegar, and then optionally dry the surface of the nylon material after molding, and prior to any dyeing steps. However, this is optional. On that note, the molded nylon egg is preferably placed in water or vinegar at approximately boiling temperature, for a period not exceeding 10 minutes, and more preferably, for about 3–10 minutes to absorb a selected amount of water, and then removed. When treated in this fashion, the coloration can be approximately 300% more intense, to the observer, as compared to those nylon eggs that are not so conditioned. Furthermore, it is preferred that once so heat conditioned in aqueous media, or even in the absence of such heat conditioning, the molded nylon is substantially sealed in air-tight packaging, such as a zip-lock or foil bag, to preserve the enhanced color uptake characteristics by substantially maintaining the water absorbed within said nylon resulting from such conditioning. It is also preferable to wrap the manufactured parts in zip lock or foil bags within 4 hours of manufacturing to facilitate their color uptake characteristics.

As noted, once so conditioned, color decoration is preferably accomplished through submersion of the plastic into an aqueous dye or one can readily apply the dye to the plastic itself. Dyes are preferably those aqueous dyes commonly employed during the Easter holidays for coloring of real eggs, which dyes are activated with vinegar or other acidic media. Alternatively, one can employ food coloring, which provides enhanced color, but which unfortunately can leave the user with a strong hand stain. In addition, it is noted that larger dye tablets with a corresponding increase in vinegar concentration provide a much better dye effect. Furthermore, it has been found that the combination of heat and moisture positively influence dye uptake on the nylon parts, whereas application of heat separate from moisture treatment appears to have a negative influence on the intensity of coloration.

In connection with exposure of the plastic material to dye, time, is of course, a factor. It has been found that in connection with nylon dyeing, relatively increased color intensity is observed as one extends the contact period between the eggs and the dye to preferably a time not exceeding about 10.0 minutes. Furthermore, at around 10 minutes, the rate of increase in intensity of the resulting color pattern decreases. That being the case, the nylon egg is, as noted, is preferably made to remain in contact with the dye for a period not exceeding 10.0 minutes, however, exposure times of between 1–6 minutes are also preferred, and in a most preferred embodiment, exposure is adjusted between about 3–5 minutes. In addition, it is also preferred to contact the nylon with the dye for a period of about 2–6 minutes.

Furthermore, it has been found preferable to heat the dye either with the nylon in it or prior to contact with the plastic nylon substrate, and in this regard, it can be conveniently achieved by microwaving the dye for a period of less than about 1.0 minute in a conventional consumer microwave oven which are typically rated at about 500 to 1100 watts and thereby achieve a dye temperature of between about 90–200° F. Preferably, the dye is heated for about 10–50 seconds, and in a most preferred case, the dye is microwaved for about 10–30 seconds, and in an even more preferred case, the dye is heated for about 20 seconds. Dye heated for 1 minute was at a temperature of about 170° F., dye heated for 50 seconds was at about 160° F., dye heated for about 40 seconds was at about 145° F., dye heated for 30 seconds was at about 130° F., and dye heated for 20 seconds was at about 110° F.

Finally, in accordance with the present invention, the plastic material to be decorated herein, preferably in the form of an injection molded nylon egg-shaped material, is decorated by one of several preferred techniques. In one alternative embodiment, the dye is delivered to the egg by immersing the egg in the dye so that a desired portion of the egg is submerged, and dye is absorbed into the nylon plastic. In this fashion, the dye does not bleed into one another as different portions are exposed to different colors. When one dyed area is subsequently dyed with a different color, it has been observed that the dyed nylon will then show a blending of colors.

Alternatively, decoration can be achieved by what can be described as a felt technique. That is, an absorbent piece of cloth, sponge or paper is cut into small strips (e.g., 0.5 inch by 3.0 inch) and dipped into different dye colors and applied to one or both sides of the nylon eggs. Alternatively, one can actually wrap the nylon eggs in dipped felt to effect dye transfer. In addition, the felt can be cut into specific shapes to create a picture decoration on the egg surface at a desired location. The felt can be left in contact with the nylon material, overnight, for a period between 6–12 hours.

In addition, in one particularly preferred embodiment, the dipped felt is made to contact the egg and the egg and felt are placed in the microwave oven for less than about 1.0 minute, preferably about 10–40 or 10–20 seconds, and allowed to cool for about 3.0–5.0 minutes before the felt is removed. In this manner, very rich colors are observed in the nylon egg surface.

In addition, in the context of this alternative embodiment, the nylon egg and felt can be baked in a conventional oven at about 300–400° F. for a period not exceeding about 10 minutes, preferably about 2–10 minutes, more preferably 3–5 minutes, and again, cooled for about 3–5 minutes before removing the felt. In addition, the dipped felt and nylon can be allowed to remain in contact overnight, or for at least a period of about 6–8 hours.

In addition, to assist in preserving the permanency of the decorated product, a coat of UV protectant is preferred. This can include a spray such as "Krylons UV Resistant Clear Acrylic Coating" or a brushed on application of similar type. In addition, the coating can include one of the many non-toxic versions such as "Delta Ceramcoats Gloss Exterior Varnish" for indoor and outdoor use.

Following decoration as noted herein, it has been found that such provides a nicely decorated and colored nylon plastic egg, which provides a permanent keepsake novelty item. Of course, various modifications and variations of the present invention are possible in light of the above teachings. It is, therefore, to be understood that within the scope of the appended claims, the invention may be practiced otherwise than specifically described:

I claim:

1. A process for permanently affixing a decorative color or color pattern to a nylon plastic material comprising:

supplying a molded nylon material, wherein the nylon material has been molded at a temperature between 420–540° F., and cooled to a temperature between 70–200° F.;

heating the molded nylon material in an aqueous medium, and then drying the surface of said nylon material before contacting the said molded nylon material with an aqueous based dye, wherein the dye remains in contact with the nylon for a period not exceeding about 10.0 minutes.

2. The process of claim 1 wherein said temperature for molding is about 520° F., and said cooling temperature is about 180° F.

3. The process of claim 1, wherein said nylon material is heated by being placed in boiling water or vinegar solution for a time not exceeding 10 minutes.

4. The process of claim 1, wherein said dye is heated during or prior to contacting said molded nylon material.

5. The process of claim 4 wherein said dye is heated to about 90–200° F.

6. The process of claim 1, wherein said aqueous based dye contains vinegar.

7. The process of claim 1 wherein said dye is an aqueous based food coloring.

8. The process of claim 7 wherein said aqueous based food coloring contains vinegar.

9. The process of claim 1, further including the step of, subsequent to contacting with said dye, coating said nylon material with a UV absorbing coating.

10. The process of claim 1, wherein said contacting of said molded nylon material with aqueous based dye comprises immersing said molded nylon material in said aqueous based dye.

11. The process of claim 1 wherein said contacting of said molded nylon material with aqueous based dye comprises contacting for a period of about 2–6 minutes.

12. The process of claim 1 wherein said contacting of said molded nylon material with aqueous based dye comprises contacting for a period of about 3–5 minutes.

13. A process for permanently affixing a decorative color or color pattern to a nylon plastic material comprising:

supplying a molded nylon material, wherein the nylon material has been molded at a temperature range of between 420–540° F., and cooled to a temperature between 70–200° F.;

heating the molded nylon material in an aqueous medium and then drying the surface of said nylon material prior to contacting the said molded nylon material with an aqueous based dye.

14. The process of claim 13 wherein the dye remains in contact with the nylon for a period not exceeding 10.0 minutes.

15. The process of claim 14, wherein the dye remains in contact with the nylon for a period of about 3–5 minutes.

16. The process of claim 13 wherein the dye remains in contact with the nylon for a period of 6–12 hours.

17. The process of claim 13, wherein said dye is heated during or prior to contacting said molded nylon material.

18. The process of claim 13 wherein said dye is heated to about 90–200° F.

19. The process of claim 13 further including the step of sealing the molded nylon in a substantially air-tight package and storing said molded nylon in said package prior to contacting with said dye.

20. The process of claim 13 further including the step of coating the molded nylon material with a UV resistant coating.

21. A kit for permanently affixing a decorative color or color pattern to a nylon plastic material comprising the following components: an egg-shaped molded aliphatic nylon material, wherein the nylon material has been molded at a temperature range of between 420–540° F., and cooled to a temperature between 70–200° F., wherein said molded nylon material has been sealed in a substantially airtight package within four hours of molding; said kit further including an aqueous dye for coloring said molded nylon article.

22. The kit of claim 21, further including an applicator for applying dye to the molded nylon material.

23. The kit of claim 21, wherein said aliphatic nylon comprises nylon-6 or nylon-6,6.

24. The kit of claim 21, wherein said molded nylon plastic material in said kit is, subsequent to said molding and cooling, obtained by boiling said nylon plastic in water or aqueous vinegar solution for a period not exceeding about 10 minutes to absorb a selected amount of water, surface dried and sealed in said kit to substantially maintain said absorb water within said nylon.

25. A process for permanently affixing a decorative color or color pattern to a nylon plastic material comprising:

supplying a molded nylon material, wherein the nylon material has been molded at a temperature range of between 420–540° F., and cooled to a temperature between 70–200° F.;

heating the molded nylon material in an aqueous medium, comprising placing said molded nylon material in boiling water or aqueous vinegar medium, drying the surface of said nylon material and storing said material in a sealed container prior to contacting with aqueous dye; and contacting said molded nylon material with an aqueous based dye, wherein the dye remains in contact with the nylon for a period not exceeding about 10.0 minutes.

26. The process of claim 25, wherein said nylon material is placed in said boiling water or vinegar solution for a time not exceeding 10 minutes.

27. The process of claim 25, wherein said dye is heated during or prior to contacting said molded nylon material.

28. The process of claim 27, wherein said dye is heated to about 90–200° F.

29. The process of claim 25, wherein said aqueous based dye contains vinegar.

30. The process of claim 25, wherein said dye is an aqueous based food coloring.

31. The process of claim 30, wherein said aqueous based food coloring contains vinegar.

32. The process of claim 25, further including the step of, subsequent to contacting with said dye, coating said nylon material with a UV absorbing coating.

33. The process of claim 25, wherein said contacting of said molded nylon material with aqueous based dye comprises immersing said molded nylon material in said aqueous based dye.

34. The process of claim 25, wherein said contacting of said molded nylon material with aqueous based dye comprises contacting for a period of about 2–6 minutes.

35. The process of claim 25, wherein said contacting of said molded nylon material with aqueous based dye comprises contacting for a period of about 3–5 minutes.

36. The process of claim 25, wherein said contacting of said molded nylon material with said aqueous based dye comprises supplying a felt material and contacting said felt with said aqueous based dye and applying said felt to said molded nylon material and heating said nylon material and said felt in a microwave oven for less than about 1.0 minute.

37. The process of claim 25, wherein said contacting of said molded nylon material with said aqueous based dye comprises supplying a felt material and contacting said felt with said aqueous based dye and applying said felt to said molded nylon material and heating said nylon material and said felt in an oven heated to about 300–400° F. for a time not exceeding about 10 minutes, followed by removing said nylon material and felt from said oven, cooling for about 3–5 minutes, and removing the felt from said nylon material to provide said color or color pattern to said nylon.

38. The process of claim 37, wherein said nylon material and said felt are heated in said oven for about 3–5 minutes.

39. A process for permanently affixing a decorative color or color pattern to a nylon plastic material comprising:

supplying a molded nylon material, wherein the nylon material has been molded at a temperature range of between 420–540° F., and cooled to a temperature between 70–200° F.;

heating the molded nylon material in an aqueous medium; and contacting said molded nylon material with an aqueous based dye, wherein the dye remains in contact with the nylon for a period not exceeding 10 minutes, comprising supplying a felt material and contacting said felt with said aqueous based dye and applying said felt to said molded nylon material and heating said nylon material and said felt in a microwave oven for less than about 1.0 minute.

40. The process of claim 39, including the step of leaving the felt on said nylon material for a period of 3–5 minutes.

41. The process of claim 39, wherein said nylon material is removed from said microwave and said felt is allowed to remain in contact with said nylon for a period of about 3–5 minutes.

42. The process of claim 39, wherein said heating of said nylon material and said felt in said microwave oven is carried out over a period of about 10–40 seconds.

43. The process of claim 39, wherein said heating of said nylon material and said felt in said microwave oven is carried out over a period of about 10–20 seconds.

44. The process of claim 39 further including the step of coating the molded nylon material with a UV resistant coating subsequent to contacting with said dye.

45. The process of claim 39 further including the step of sealing the molded nylon in a substantially air-tight package and storing said molded nylon in said package prior to contacting with said dye.

46. A process for permanently affixing a decorative color or color pattern to a nylon plastic material comprising:

supplying a molded nylon material, wherein the nylon material has been molded at a temperature range of between 420–540° F., and cooled to a temperature between 70–200° F.;

heating the molded nylon material in an aqueous medium; and contacting said molded nylon material with an aqueous based dye, wherein the dye remains in contact with the nylon for a period not exceeding 10 minutes, comprising supplying a felt material and contacting said felt with said aqueous based dye and applying said felt to said molded nylon material, and heating said nylon material and said felt in an oven heated to about 300–400° F., followed by removing said nylon material and felt from said oven, cooling for about 3–5 minutes, and removing the felt from said nylon material to provide said color or color pattern to said nylon.

47. The process of claim 46, wherein said nylon material and said felt are heated in said oven for about 3–5 minutes.

48. A process for permanently affixing a decorative color or color pattern to a nylon plastic material comprising:

supplying a molded nylon material, wherein the nylon material has been molded at a temperature range of between 420–540° F., and cooled to a temperature between 70–200° F.; and sealing the molded nylon in a substantially air-tight package within 4 hours after said molded nylon material has been molded; and contacting said molded nylon material with an aqueous based dye.

49. The process of claim 48, wherein the dye remains in contact with the nylon for a period not exceeding 10.0 minutes.

50. The process of claim 49, wherein the dye remains in contact with the nylon for a period of about 3–5 minutes.

51. The process of claim 48, wherein the dye remains in contact with the nylon for a period of 6–12 hours.

52. The process of claim 48, wherein said dye is heated during or prior to contacting said molded nylon material.

53. The process of claim 48, wherein said dye is heated to about 90–200° F.

54. The process of claim 48, wherein said contacting of said molded nylon material with said aqueous based dye comprises supplying a felt material and contacting said felt with said aqueous based dye and applying said felt to said molded nylon material and heating said nylon material and said felt in an oven heated to about 300–400° F. for a time not exceeding about 10 minutes, followed by removing said nylon material and felt from said oven, and removing the felt from said nylon material to provide said color or color pattern to said nylon.

55. The process of claim 54, including the step of leaving the felt on said nylon material for a period of about 3–5 minutes after removal from said heated oven.

56. The process of claim 48, wherein said contacting of said molded nylon material with said aqueous based dye comprises supplying a felt material and contacting said felt with aqueous based dye and applying said felt to said molded nylon material and heating said nylon material and said felt in a microwave oven for less than about 1 minute.

57. The process of claim 56, wherein said nylon material is removed from said microwave and said felt is allowed to remain in contact with said nylon for a period of about 3–5 minutes.

58. The process of claim 56, wherein said heating of said nylon material and said felt in said microwave oven is carried out over a period of about 10–40 seconds.

59. The process of claim 56, wherein said heating of said nylon material and said felt in said microwave oven is carried out over a period of about 10–20 seconds.

60. The process of claim 48 further including the step of coating the molded nylon material with a UV resistant coating.

61. A process for permanently affixing a decorative color or color pattern to a nylon plastic material comprising supplying a molded nylon material, said nylon material having been molded at a temperature of between 420–540° F. and cooled to a temperature between 70–200° F., contacting said molded nylon material with an aqueous based dye, wherein said contacting of said nylon material with said aqueous based dye comprises supplying felt material and contacting said felt with said aqueous based dye and applying said felt to said molded nylon material followed by heating said nylon material and said felt for a time sufficient to transfer said aqueous based dye from said felt to said nylon, and removing said felt from said nylon to provide said decorative color to said nylon.

62. The process of claim 61 wherein said heating comprises heating in a microwave oven.

63. The process of claim 62 wherein said heating is carried out over a period of 10–40 seconds.

64. The process of claim 61 including the step of removing said heating and leaving the felt on said nylon for a period of about 3–5 minutes before said felt is removed.

65. The process of claim 61 wherein said heating comprises heating at about 300–400° F. for a time not exceeding about 10 minutes.

66. The process of claim 65 wherein said time is about 3–5 minutes.

* * * * *